United States Patent [19]

DeJule et al.

[11] 3,938,135

[45] Feb. 10, 1976

[54] GAS DISCHARGE DISPLAY DEVICE AND AN IMPROVED CELL THEREFOR

[75] Inventors: Michael C. DeJule, Chicago, Ill.; David Glaser, Greenbrook, N.J.

[73] Assignee: Zenith Radio Corporation, Chicago, Ill.

[22] Filed: Nov. 27, 1974

[21] Appl. No.: 527,568

[52] U.S. Cl. ..... 340/324 M; 178/7.3 D; 313/188; 313/217; 315/169 TV

[51] Int. Cl.[2] ..... G08B 5/36

[58] Field of Search ..... 340/324 M; 315/169 R, 169 TV; 313/188, 217; 178/7.3 D

[56] References Cited

UNITED STATES PATENTS

| | | | |
|---|---|---|---|
| 3,626,235 | 12/1971 | Kupsky | 315/169 TV |
| 3,683,364 | 8/1972 | Holz et al. | 340/324 M |
| 3,771,008 | 11/1973 | Chen et al. | 313/188 X |
| 3,800,186 | 3/1974 | Yamane et al. | 315/169 TV |
| 3,859,559 | 1/1975 | Glaser | 315/169 TV |

*Primary Examiner*—David L. Trafton

[57] ABSTRACT

A gas discharge display panel and an improved cell therefor. Each cell includes a cathode at one end and a video anode at its other end with a main discharge path between the video anode and the cathode. A priming anode extends along a substantial part of the main discharge path for establishing a priming discharge in the cell which is progressively propagated by the priming anode along the main discharge path toward the video anode. By priming substantially the entire distance between the cathode and the video anode, a low level video signal on the video anode may be used to sustain and control the primed discharge.

8 Claims, 6 Drawing Figures

VIDEO SIGNAL
VIDEO SIGNAL
36A
36B
38A
38B
34A
34B
32A
32B
CELL A
CELL B
40A
40B
35A
35B
30
31
42

VIDEO SIGNAL
VIDEO SIGNAL
18A
18B
20A
20B
14A
14B
CELL A
CELL B
22
24A
24B
26
10A
10B
12
15
17
19

VIDEO SIGNAL
VIDEO SIGNAL
18A
18B
20A
20B
14A
14B
16
CELL A
CELL B
18
10A
10B
12
15
17
19

GAS DISCHARGE DISPLAY DEVICE AND AN IMPROVED CELL THEREFOR

BACKGROUND OF THE INVENTION

This invention is related to visual display devices. It is particularly directed toward an improved gas discharge display for use in flat panel television, alpha-numeric displays and the like.

Gas discharge displays generally include a matrix of rows and columns of individual gas discharge cells. Typically, there are corresponding matrices and rows of columns of wire conductors which intersect at the individual cell locations. Each cell has at least an anode conductor and a cathode conductor between which a low pressure atmosphere of a gas, such as a rare gas or a rare gas and mercury vapor, is maintained. When a sufficient potential is applied between an anode conductor and a cathode conductor, a gas discharge is developed at the cell which is located at their intersection. A visible "cathode glow" is then established near the cathode and, in some applications, it is that glow which is used as the visible light output of the cell.

Between the anode conductor and the cathode glow a plasma or "positive column" may exist which includes energetic electrons, metastables and ions. These particles are continuously recombining, regenerating and colliding. The collision of an energetic electron with a gas atom produces a high energy state in the atom's electron shell which decays to a lower energy state, thereby causing an emission of radiation from the atom and from the positive column. The gas constituents and the operating parameters of a cell may be chosen such that the radiation emanating from a positive column is in the UV (ultraviolet) spectrum. The UV radiation may then be converted into visible light of a predetermined color by directing the UV radiation onto a UV-excitable phosphor coated on one or more of the cells walls.

When excited by the UV radiation, the phosphor coating emits visible light of the predetermined color. It is with this mode of generating visible light from a gas discharge cell that this invention is primarily concerned, although certain aspects of it are also applicable to applications utilizing only the cathode glow as the source of light output, as well as to applications where light is produced by direct electron excitation of a phosphor.

In the past, gas discharge displays have suffered from a number of problems, one which has been the high voltage required to drive the anode conductors in order to establish a discharge in selected cells. In typical commercial applications, anode conductors are driven with a potential of several hundred volts, generally in the form of a time-varying signal which corresponds to video information. In a television application, a typical gas discharge panel will have several hundred anode conductors, one for each column of the panel, and each driven by a video driver. To implement the circuitry required for such a system would be prohibitively expensive unless the circuitry could be realized in integrated circuit (IC) form. Since present IC technology is, for the most part, limited to the production of circuitry capable of handling less than 150 volts, the video drivers can probably not be profitably integrated at this time. Instead, a discrete high voltage video driver is probably required for each anode conductor. A display incorporating discrete video drivers for each anode conductor would obviously be too expensive for consumer applications.

Another problem which has been associated with many flat panel displays is the complexity of the display. Some displays are constructed of many layers which must be accurately aligned with one another. This type of construction is undesirable from a production standpoint, particularly where the final product is intended for the mass consumer market.

A flat panel display which is intended to be a consumer product should, therefore, incorporate a solution to the problem of needing hundreds of discrete video drivers, without increasing, and hopefully decreasing, the customary complexity of prior art displays.

OBJECTS OF THE INVENTION

It is a general object of this invention to provide an improved gas discharge display panel.

It is a more specific object of this invention to provide a gas discharge display which functions with lower voltage video signals so that the video drivers therefore may be fabricated in integrated circuit form, and to provide this improvement in a gas discharge panel having a relatively simple structure.

BRIEF DESCRIPTION OF THE DRAWINGS

The features of the invention which are believed to be novel are set forth with particularity in the appended claims. The invention, together with further objects and advantages thereof, may best be understood by reference to the following description taken in conjunction with the accompanying drawings in which:

DESCRIPTION OF THE PREFERRED EMBODIMENT

Before beginning the explanation of this invention, a brief examination of a typical prior art gas discharge cells will be undertaken. A simplified schematic view of a pair of such cells is shown in FIG. 1.

Figures 1, 2, 3:
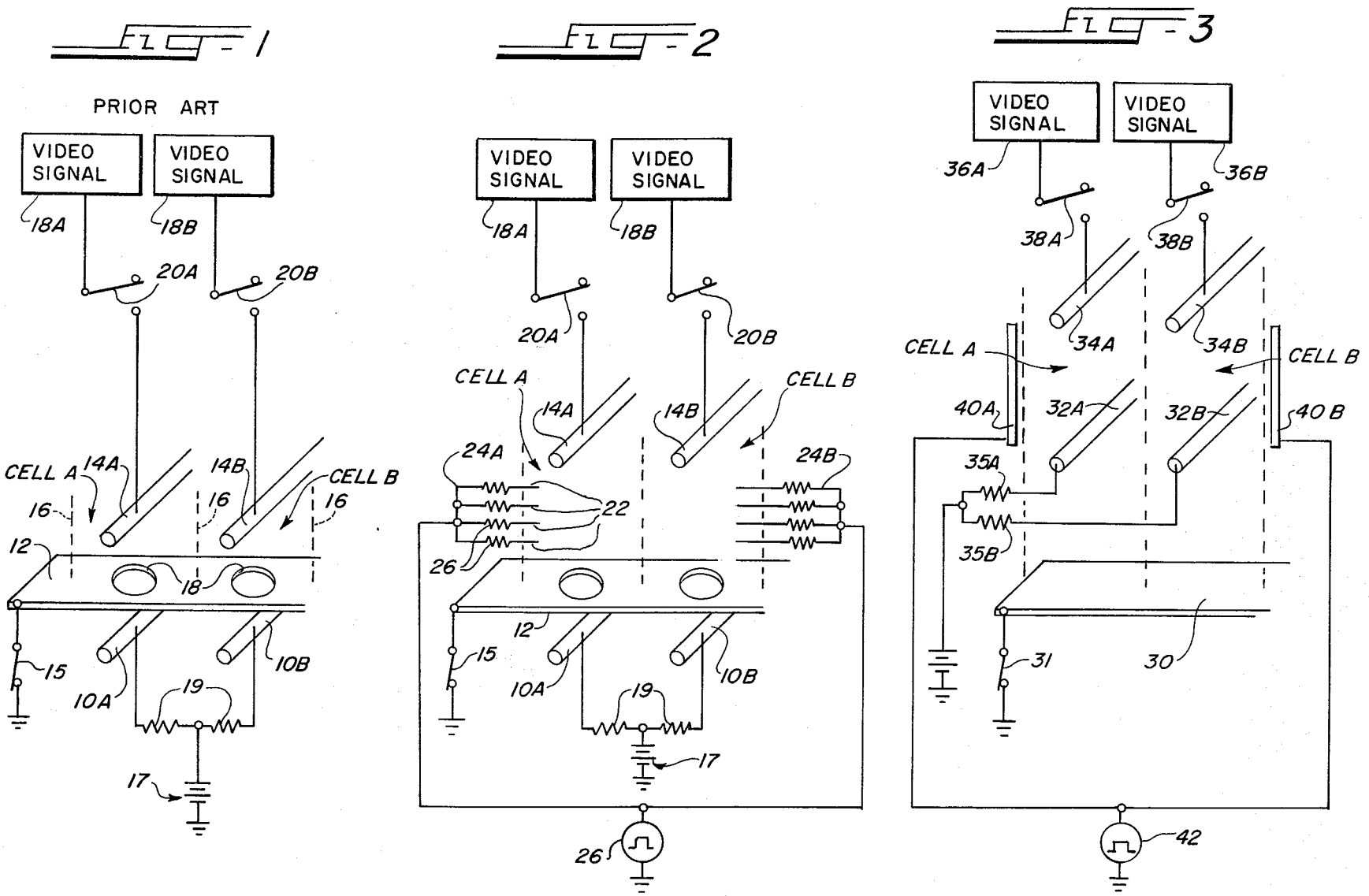
FIG-1 PRIOR ART
FIG. 1 depicts, in schematic and simplified form, a prior art matrix of two gas discharge cells for use in a gas discharge display panel.
FIG. 2 schematically depicts a matrix of two gas discharge cells which illustrate one aspect of this invention.
FIG. 3 depicts, in schematic form, a matrix of two gas discharge cells which illustrate another aspect of this invention.

Cells A and B are two cells in a row of cells which extends horizontally in FIG. 1. Cell A includes a portion of a column-wise extending scan anode 10A, a portion of a row-wise extending cathode conductor 12 and a portion of column-wise extending video anode 14A. Cell B has a similar set of electrodes. The location of each cell is defined by the intersection of a scan anode and cathode conductor 12. For simplicity and ease of explanation, no cell enclosure has been shown. However, each cell is assumed to be confined to the areas bounded by dashed lines 16 and to be filled with an appropriate gas at a pressure conductive to the generation of a gas discharge therein.

In operation, cathode conductor 12 is grounded through switch 15. With scan anodes 10A and 10B connected through current limiting resistors 19 to a source 17 of DC voltage, +250 volts for example, a scan or auxiliary discharge is established between cathode conductor 12 and the scan anode of each cell in the row of cells served by cathode conductor 12. Due to the scan discharge existing in each such row of cells, electrodes, ions and metastables are generated in the area between scan anodes 10A, 10B and cathode conductor 12. Some of these excited particles diffuse through apertures 18 in cathode conductor 12 and up into the main or display discharge chambers bounded by dashed lines 16 between cathode conductor 12 and video anodes 14A and 14B. This diffusion of excited particles into the display discharge chambers "primes" each display discharge chamber so that a discharge is more easily established between cathode conductor 12 and video anodes 14A and 14B. Without such priming, a much larger voltage on the video anodes would be required to establish the discharges in the display discharge chambers.

When it is desired to establish a discharge in the display discharge chamber of cell A, a video signal is applied to video anode 14A from a video signal source 18A through switch 20A. If the video signal is in order of +250 volts, a discharge is established in cell A. Likewise, if switch 20B is actuated, video signal source 18B creates a discharge in the display discharge chamber of cell B. Usually, switches 20A and 20B are actuated simultaneously since it is desirable to generate video controlled discharges simultaneously in each cell of a row.

When the FIG. 1 cells are used in a display which is scanned row-by-row, it is desirable to transfer the scan discharge of the last ON row to the next adjacent row so that the next adjacent row can be primed before it receives its video signals. This row-by-row transfer of the scan discharge can be effected, for example, by removing the ground connection to the cathode conductor of the ON row and grounding the cathode conductor of the adjacent row to which the discharge is to be transferred.

A typical application for the type of cells shown in FIG. 1 is where, when a discharge is created in a cell, a cathode "glow" is established around the cathode of the ON cell. It is this glow which is then used as the visible light output of the cell.

When a gas discharge panel which is constructed generally as shown in FIG. 1 is used to display a television image, it will need approximately 500 columns of cells and a corresponding number of video anodes, one for each column. For each video anode, a video driver is required to supply it with a video signal having an amplitude in the order of 250 volts. As pointed out above, it is presently impractical to fabricate video drivers capable of handling 250 volts in integrated circuit form. Therefore, a separate discrete video driver is required for each of the 500 video anodes. It is, therefore, highly desirable to reduce the required level of video driver to 100 volts or less so that the video drivers may be fabricated in integrated circuit form. This would make such gas discharge displays much more practical and economical, particularly for consumer use.

The gas discharge cells shown in FIG. 1 are, in accordance with one aspect of this invention, improved as shown in FIG. 2 to reduce the required level of video driver for the video anodes.

As shown in FIG. 2, the improved construction still utilizes a set of column-wise extending priming anodes 10A and 10B and a row-wise extending cathode conductor 12. The scan discharges are established in the same manner as described above for FIG. 1. In the improved cells of FIG. 2, however, there are included priming anodes 24A and 24B which are coupled to a source 26 of priming pulses. The illustrated version of each priming anode 24A and 24B has a number of electrodes 22 which protrude into the main discharge chambers of the cells and a like number of current limiting resistors 26.

With a row of scan discharges established between scan anodes 10A, 10B and cathode conductor 12, a priming pulse is applied to priming anodes 24 prior to the application of video signals to video anodes 14A and 14B. If the priming pulse has an amplitude of approximately 250 volts, a discharge will be established between the electrode 22 nearest cathode 12. Although a priming pulse of this amplitude is insufficient to initiate a discharge between the electrode 22 farthest from cathode 12, a discharge will nevertheless propagate upwardly from one electrode 22 to another until a discharge exists between cathode conductor 12 and each electrode 22 of priming anodes 24. This propagation of the discharge upwardly through the display discharge chambers is caused by the priming of adjacent areas of the chambers by the discharge which is first established between the electrode 22 which is closest to cathode conductor 12. For example, when a discharge is established between the electrode 22 closest to cathode 12, electrons, ions and metastables diffuse upwardly toward the next closest electrode, thus priming that area and enabling a discharge to be established at that next adjacent electrode without the need for a higher level priming pulse at that electrode. This propagation of the discharge continues until a discharge is established along the length of the display discharge chamber adjacent each electrode 22.

With a substantial length of the FIG. 2 cell primed, the discharge initiated by priming anode 24 is easily sustained by a relatively low level video signal applied to video anode 14. The video signal must begin during the presence of a priming pulse in order to sustain the discharge. Once the video signal controls the discharge, it can modulate it in accordance with the information content of the video signal.

Because of the discharge created in the display discharge chambers by priming anodes 24A and 24B, these chambers may be longer than their counterparts of FIG. 1 while still not requiring a high level video signal on video anode 14A and 14B. The increase in distance now possible between cathode conductor 12 and video anodes 14A and 14B allows a longer and more efficient positive column to be established in each cell. Therefore, the cells constructed according to FIG. 2 will generally be used to create a light output by exciting a phosphor target (not shown) with the positive column rather than relying on the light from the cathode glow.

FIG. 3 shows another pair of gas discharge cells which illustrate another aspect of this invention. In the description of the FIG. 3 cell structures, reference will be made only to the elements of cell A to simplify the discussion. Elements of cell B operate in the same manner as their cell A counterparts.

As shown in FIG. 3, cathode conductor 30 is grounded through switch 31. It is the bottom-most element of these cells and contains no apertures as the cathode conductors of FIGS. 1 and 2 do. Situated above cathode conductor 30 are scan anodes 32A and 32B, corresponding to columns A and B, respectively. Each scan anode is connected to a suitable DC voltage source through current limiting resistors 35A and 35B. In this embodiment, a scan discharge chamber exists above cathode conductor 30, between it and scan anode 32A. This scan discharge chamber is now adjacent to the display discharge chamber existing between scan anode 32A and video anode 34A.

Cell A of FIG. 3 includes video anode 34A, video signal source 36A, and switch 38A for applying a video signal to video anode 34A. Along the display discharge chamber of cell A is situated a priming anode 40A for priming the cell. One difference between priming anode 40A of FIG. 3 and priming anode 24A of FIG. 2 is that priming anode 40A does not protrude into the main discharge chamber of cell A. A sheet of insulation (not shown) is positioned between priming anode 40A and the cell. If priming anode 40A is made of a conductive material, the insulator between it and its adjacent cell will act as a dielectric so that an effective capacitor is formed between priming anode 40A and cathode conductor 30.

In operation, a row of scan discharges is first generated between cathode conductor 30 and each scan anode with which it communicates. Next, a priming pulse from source 42 is applied to priming anodes 40A and 40B (and every other priming anode of that row). Because of the capacitive coupling between priming anode 40A and cathode conductor 30, an electric field is established in the display discharge chamber of cell A. Because of this electric field and the fact that the scan discharge of cell A is adjacent to its display discharge chamber, the discharge is drawn up into each cell and toward priming anode 40A. Because of the proximity of that portion of priming anode 40A which is nearest to cathode conductor 30, the discharge is first drawn or extended to that lower portion thereof. This extended discharge tends to prime adjacent areas of the display discharge chamber adjacent to priming anode 40A and permits the discharge to be drawn upwardly until it extends to that portion of priming anode 40A which is farthest from cathode conductor 30.

The electrons which are thus drawn toward priming anode 40A tend to discharge the capacitor formed between priming anode 40A and cathode conductor 30 so that the extended discharge in the display discharge chamber tends to automatically decay as the capacitor is discharged. However, before the discharge in cell A terminates, a video signal is applied to video anode 34A through switches 38A for sustaining and modulating the capacitively induced discharge in accordance with the information content of the video signal.

As with the FIG. 2 embodiment, the video signal applied to video anode 34A of the FIG. 3 embodiment need not be large since the cell has already been primed by the capacitively induced discharge in its display discharge chamber.

In addition to the efficient priming made possible by priming anode 40A in FIG. 3, the ordering of electrodes 34A, 32A and 30 within cell A also helps promote very efficient priming. Because of the fact that with the FIG. 3 structure the scan discharge area (between scan anode 32A and cathode conductor 30) is adjacent to the display discharge area (between video anode 34A and scan anode 32A) the electron cloud which exists in the scan discharge area is easily drawn into the display discharge area to supply it with a rich source of electrons. This "electron injection" of the electron cloud into the display discharge area will prime the display discharge area so that a discharge can be established therein much more easily than in many prior art priming methods. For example, in FIG. 1 the display discharge area of cell A is between video anode 14A and cathode conductor 12. The display discharge area of this prior art structure is primed by the diffusion of gas metastables through aperture 18 in cathode element 12 and up into the display discharge area. A disadvantage of the diffusion priming of the display discharge area by gas metastables is that the voltages which must be applied to create a fast discharge in the display discharge area will be larger than those required for a structure in which the main discharge area is primed by electron injection. Another disadvantage of such priming is that the gas metastables have a relatively long lifetime in comparison to that of the electrons used in electron injection priming. As a result, the scanning rate of such a prior art gas discharge cell is reduced by at least an order of magnitude over the scanning rate possible with electron injection priming.

In order to take full advantage of this invention, it is desirable that a gas discharge cell use electron injection priming and a priming anode adjacent to the display discharge area as shown schematically in FIG. 3. In addition, the cell should be so constructed that a minimum number of priming anodes are required in order to minimize the number of high voltage drivers required to provide the high voltage priming pulses. However, the capacitive priming electrodes of FIG. 3, 40A and 40B, may also be used with the type of cells shown in FIG. 2 to establish discharges in the display discharge chambers, which discharges may then be sustained and controlled by a relatively low level video signal on video anode conductors 14A and 14B.

Figure 4:
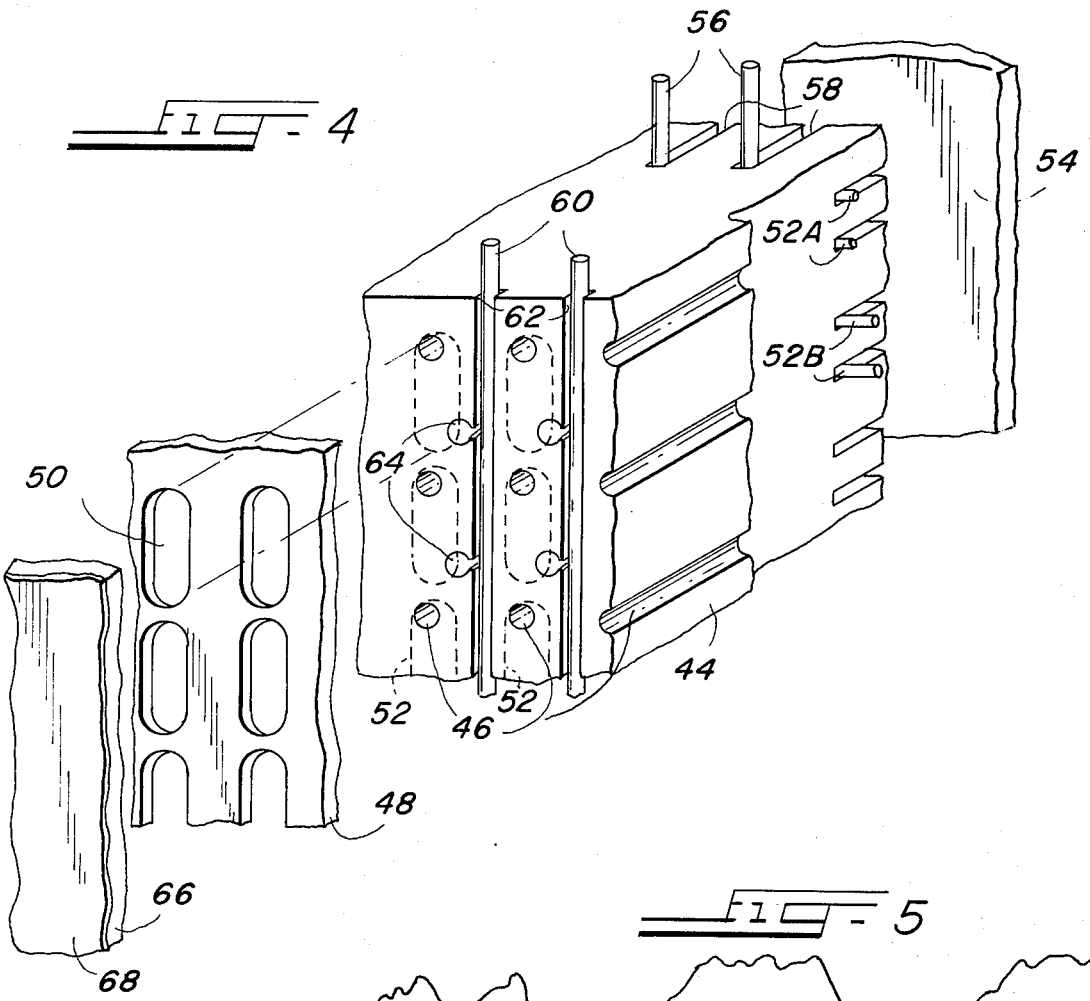
FIG. 4 is an exploded view of a gas discharge panel constructed in accordance with this invention.

An embodiment of this invention which includes the above-described efficient priming with a minimum number of discrete high voltage drivers is shown in FIG. 4 in which certain dimensions have been exaggerated for clarity. The dimensions and materials of the FIG. 4 structure will be specified in the discussion below.

As shown, the gas discharge panel incorporating the above-described aspects of this invention includes a center sheet 44 which has an array of rows and columns of bore-like cavities 46. Each cavity 46 is for enclosing a gas discharge and extends through sheet 44 from front to back.

Sheet 48 has a like array of rows and columns of apertures 50. When sheet 48 is mated with center sheet 44, each aperture 50 is aligned with a particular cavity 46 as indicated by dashed lines 52. When so mated, apertures 50 and cavities 46 communicate as shown and form an array of cells terminating in tub-like recesses. The bottom area of each tub is phosphor-coated so as to emit light when excited by a gas discharge.

The cells of the FIG. 4 gas discharge panel have a novel cathode structure, claimed in co-pending application Ser. Nol 527,569, filed Nov. 29, 1974, which operates as a hollow cathode for generating efficient high current gas discharges. In addition, a portion of the FIG. 4 cathode structure is adapted to generate an auxiliary or scan discharge in each ON row of cells, which discharge can be transferred to the next adjacent row by the row-by-row energization of successive cathodes in a manner to be described.

For each row of cells, there is a row-wise extending pair of cathode scanning wires. Wires 52A communicate with row A, wires 52B with row B, etc.

Situated within slots 58 in center sheet 44 is a set of column-wise extending scan anodes 56, one for each column of the array. In operation, scan anodes 56 receive a DC voltage to establish scan discharges between themselves and the pair of cathode scanning wires 52 which correspond to the row of cells then being scanned. This scan discharge which exists in the scan discharge area between scan anodes 56 and cathode scanning wires 52 has a relatively low current.

However, since cathode scan wires 52A, 52B, etc. each have a relatively small surface area, they are easily covered with a catode glow at low currents. Having the scan wires completely covered by the glow is desirable because it keeps them "clean" and prevents mis-scanning between "dirty" wires. Being able to have ones scan electrodes completely covered with the glow at low scan currents is an advantage over some prior art scan electrodes which have a ribbon-like geometry and a much larger surface area. In such cases, a much larger scan current must be established to completely cover the scan electrode.

Before applying a video signal to the cells of row A to modulate the scan discharge, the intensity of the scan discharge will be greatly increased to provide a much greater source of electrons for the display discharge. This increase in the current density of the scan discharge is accomplished by causing a hollow cathode to exist between cathode scan wires 52A and cathode sheet 54. The hollow cathode effect is created by placing cathode sheet 54 and cathode scan wires 52A at or near the same potential, −100 volts DC for example, thereby causing cathode sheet 54 to participate, along with cathode scan wires 52A, in the generation of electrons for the gas discharges occurring in row A. With cathode scan wires 52A positioned adjacent and essentially parallel to cathode sheet 54, the adjacent surfaces of each cathode element "see" each other and, as a result, operate together as a row of hollow cathodes for generating a row of high current gas discharges.

When the high current gas discharges are no longer required for row A, cathode sheet 54 is de-energized, thus returning row A to a low current gas discharge condition. This low current scan discharge may be scaned from row-to-row by the application of scanning signals to cathode scanning wires 52. The way in which the scanning is accomplished and the way in which cathode sheet 54 is energized to establish the hollow cathodes will be discussed below.

Continuing with a description of the other elements of the FIG. 4 panel, a set of column-wise extending video anodes 60 are situated within slots 62 in center sheet 44. Anodes 66 are adapted to receive an information-bearing video signal for generating a gas discharge and a visible light output in a manner to be described hereinafter. Note that video anodes 60 are in communication with apertures 50 through grooves 64.

Front sheet 66 is a transparent insulator which covers the entire top of the panel. It has a transparent conductive film 68 on the side opposite apertures 50 which acts as one plate of a capacitive priming electrode in a manner to be described.

The operation of the FIG. 4 gas discharge panel is as follows. With each scan anode 56 returned to a source of DC voltage of +250 volts, for example, and with a scanning pulse of −100 volts applied to scanning wire pair 52A, a row of scan discharges will be generated between each scan anode 56 and cathode wire pair 52A. Thus, one entire row of cells will contain a low current discharge extending between elements 56 and 52A.

Figure 5:
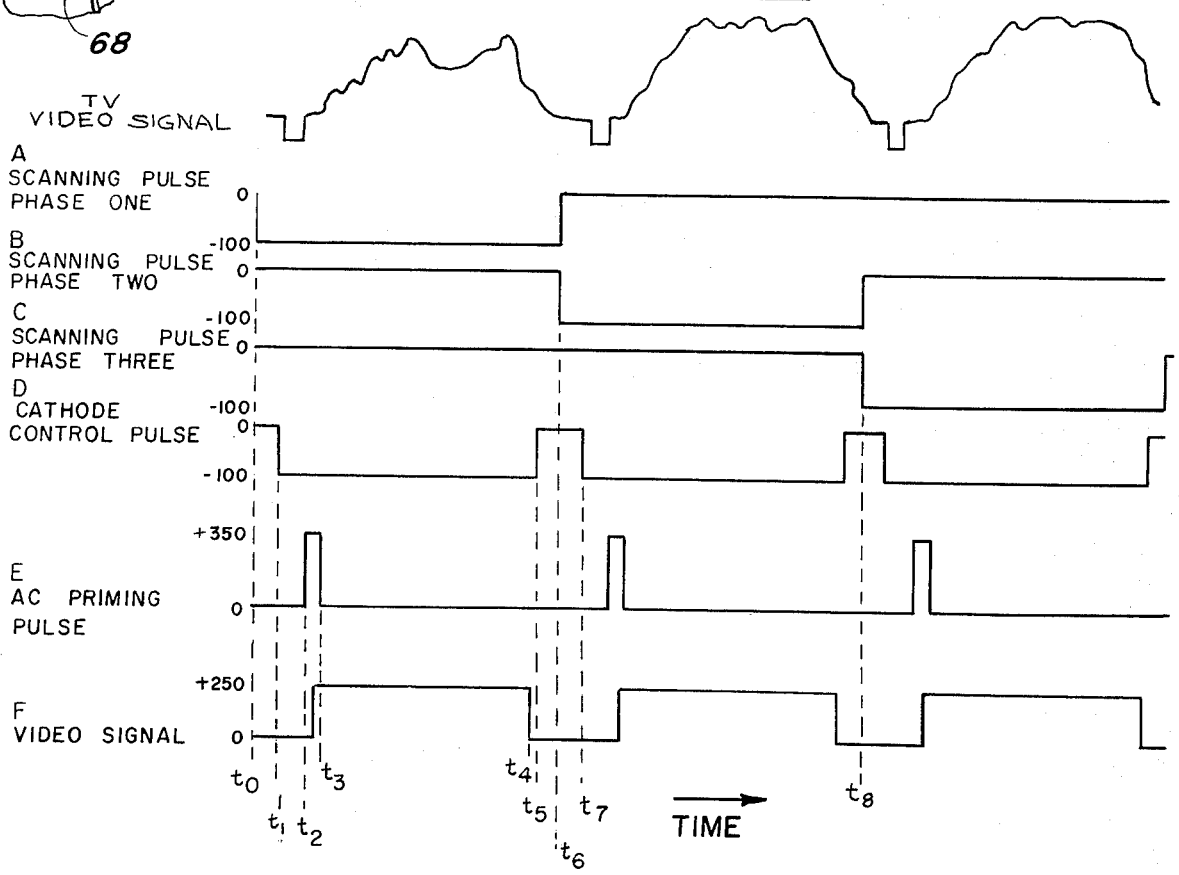
FIG. 5 depicts a series of waveforms which illustrate typical control signals used to drive the FIG. 4 panel.

The waveforms shown in FIG. 5 are illustrative of the signals applied to the various electrodes of the FIG. 4 panel. A typical television signal is also shown to illustrate the time correspondence between it and the other waveforms.

Waveform A is applied to cathode scanning wire pair 52A to generate a series of discharges along row A. At this point, cathode sheet 54 is non-emitting and contributes nothing to the discharges existing in row A. At time $t_1$ waveform D drives cathode sheet 54 negative 100 volts, thereby permitting cathode sheet 54 to participate in the generation of electrons for row A. When this occurs, scanning wire pair 52A and the portion of cathode sheet 54 adjacent thereto together form a hollow cathode which generates a high current gas discharge in each cell of row A.

At time $t_2$, as indicated by waveform E, a priming pulse of +350 volts is applied to conductive film 68 on front sheet 66. Since conductive film 68 is insulated from other elements of the panel by insulating sheet 66, an effective capacitor is formed between conductive film 68 and cathode sheet 54. When the priming pulse is applied to conductive film 68, a brief electric field is established throughout each cell of the array. In the case of the row A cells where a high current density gas discharge is taking place between cathode sheet 54 and scan anodes 56, the discharge is drawn toward film 68 through cavities 46, into the tubs formed by apertures 50. Since conductive film 68 completely covers each tub, the gas discharges in row A will spread uniformly throughout each tub in row A. The rush of electrons toward conductive film 66 tends to discharge the capacitor formed between conductive film 66 and cathode sheet 54 so that, left alone, the electric field and the gas discharges within apertures 50 of row A would automatically decay. However, prior to the decay of the discharges in apertures 50 of row A, a video signal, such as waveform F in FIG. 5, is applied to each video anode 60. The positive potential thus applied to video anodes 60 causes the gas discharges then present in apertures 50 of row A to be pulled into grooves 64 of row A and sustains the capacitively induced discharges in accordance with the information content of the video signal.

Once the video signal begins to control the main gas discharge, the priming pulse may be terminated. The width of the priming pulse is not critical since, as long as it is wide enough to insure that the video signal always begins during the presence of the priming pulse, the main gas discharge will be under the control of the video signal and the priming pulse can be terminated thereafter. However, the pulse should terminated before priming disappears in the display discharge chamber so that there will be particles available for the capacitor to discharge when the applied voltage drops to zero. Typically, the priming pulse has a duration of from 5 to 10 microseconds.

The action of the capacitive priming electrode (conductive film 68) is similar to the action of priming anode 40 of FIG. 3. In both cases, the priming electrode has one portion which is closer to the cathode than a more distant portion, thereby enabling it to draw the discharge into the display discharge chamber by a relatively low priming voltage. The discharge is then propagated along the length of the priming electrode and primes a substantial portion of the display discharge path.

In FIG. 4, the display discharge path extends from a scan anode 56, through groove 46, across a tub formed by aperture 50 and downwardly through groove 64 to video anode 60. Since the priming electrode consisting of conductive coating 68 entirely covers each tub, the priming will be drawn up into and throughout each tub in the ON row, thereby priming substantially the entire distance between cathode plate 54 and video anode 60.

Note that the amplitude of the video signal required to continue or sustain the display discharge through the cavities is only approximately 250 volts, which is less than that required to initiate a discharge. The 250 volts which sustains the display discharge is in part a DC voltage and in part an AC signal voltage. If the video anodes are DC biased at a voltage less than the sustain voltage, say 150V, then it is only necessary that the AC signal voltage supplied by the video drivers have an amplitude of 100 volts. Video drivers capable of supplying a 100 volt AC signal voltage are capable of being fabricated in integrated circuit form. Therefore, a gas discharge panel constructed according to FIG. 4 avoids the expense associated with prior art panels requiring a discrete high voltage video driver for each video anode.

Although the priming pulse required to draw the discharge upward into the tubs is 350 volts, a higher voltage than integrated circuit drivers can normally handle, only one driver capable of handling such a large pulse is required for this panel since front sheet 66 and conductive film 68 cover and prime each cavity of the panel simultaneously. The ability to prime each cell of the panel with a single high voltage driver, combined with the efficient priming of the main discharge area by electron injection makes such gas discharge panels commercially feasible by permitting the use of relatively inexpensive integrated circuit video drivers.

Referring to FIG. 5, video signal F which is applied to a video anode may modulate the gas discharge in a cell and the resultant light output thereof by having a variable amplitude or by having a variable pulse width with a constant amplitude. In either case, the video signal terminates at a time $t_4$ which occurs while the forward and rear cathode elements, 52 and 54 respectively of the FIG. 4 panel, are still in the hollow cathode mode.

At the termination of the video signal, the discharge present between video anodes 60 and cathode sheet 54 collapses, reverting to a scanning discharge in the scan discharge chambers of the ON row.

At $t_5$, the cathode control pulse (waveform D of FIG. 4) goes positive and effectively removes cathode sheet 54 from participation in the generation of the discharge. With the cathode control pulse having a shorter duration than the scanning pulse (waveform B) and time positioned such that it is applied to cathode sheet 54 subsequent to the application of the scanning pulse to a pair of cathode scanning wires and extinguished prior to the removal of the scanning pulse from the scanning wires, no cell will have a high current gas discharge when the rows are being scanned. Instead, only a low current scan discharge will exist at that time to provide a condition for the cells in which the gas discharge is more easily transferred to an adjacent row.

Referring to FIG. 5 again, at $t_6$ the scanning pulse for row B of the panel goes negative 100 volts and transfers the scan discharge from row A to row B. Concurrently, the scanning pulse applied to row A goes positive.

At $t_7$, cathode sheet 54 is pulsed negative again as indicated in waveform D. This establishes a row of hollow cathodes in row B and generates a high current scan discharge between the hollow cathode of row B and each scan anode 56. Shortly thereafter, a priming pulse (waveform E) is applied to conductive film 68 to draw the scan discharge up into the display discharge area and thus to prime each cavity and tub in row B. A video signal is then applied to each video anode 60 to sustain the display discharge and control it in accordance with the information content of the video signal.

At $t_8$, when row B is to be extinguished, the scanning pulse applied to scanning wire pair 52B of row B goes positive while the scanning pulse of the next adjacent row concurrently goes negative to transfer the discharge from row B to row C.

This method of scanning rows of a gas discharge panel by the transfer of the discharge to the next adjacent row can be applied to a panel having any number of rows. For example, in a panel having rows $r_1$–$r_n$ and a corresponding number of pairs of scanning wires $w_1$–$w_n$, a repetitive set of negative going scanning pulses $p_1$–$p_n$ successively time space from one another as shown in FIG. 4 will cause the discharge to move from row $r_1$ to row $r_n$ in synchronism with scanning pulses $p_1$–$p_n$.

In the case of a panel having $n$ rows, one need not have n distinct scanning pulses. If the rows are broken down into groups of perhaps seven rows per group, the same pulse applied to row 1 of group 1 may be applied to row 1 of group 2, row 1 or group 3, etc. In that way, corresponding rows of the different groups of rows will receive the same scanning pulse. These rows will not all have a gas discharge concurrently established within them since the discharge only travels to adjacent rows.

Referring again to the structure illustrated at FIG. 4, it is apparent that the panel shown therein is of greater simplicity than many prior art panels. For example, unitary center sheet 44 contains each recess and slot and thus does away with the need for matching up separate sheets or layers which must be in accurate registration with one another. Since center sheet 28 consists of nothing but holes, slots and grooves, no elaborate machining is required to reproduce it.

An additional advantage of the FIG. 4 structure is that it can be tiled; that is, one large panel can be made up of many discrete small center sheet portions which fit together in a pattern or mosaic to form one larger panel. Then, to insert the various wire electrodes such as scan anodes 56, video anodes 60, or cathode wires 52, each set of wires can be assembled on a harp-like jig with the wires spaced apart and held tautly in place. With the various small tiles assembled, the harp can be placed over the panel and the wires guided into place into their respective grooves. Fitting the wires into their proper grooves has the effect of aligning the tiles to their proper positions. Then, by fritting the harp into place with a glass frit, one may have what amounts to a reinforced, very sturdy and self-supporting structure. The fact that the assembled structure is self-supporting is an important advantage over many prior art panels which require additional layers merely for imparting rigidity to the completed structure. The panel can then be flipped over on its other side and the remaining wires can be laid in their appropriate grooves and fritted into place.

Since cathode sheet 54 is one large, unitary element there is no problem of registering it with the bottom side of the panel. Likewise, sheet 48 may be one large piece which need only be laid over center sheet 44 and brought into proper registration. Finally, front sheet 66 is laid over the entire front of the panel and joined thereto, thus completing the assembly of the panel, with the exception of top and bottom glass covering plates which may sandwich the completed structure. When it is desirable to make use of the filing concept, it is preferred that the tiles which constitute the perimeter of the panel not have cells along their outer edges. This will avoid the problem of sealant contaminating cells which are near the edges of the panel. The perimeter tiles should, however, include the slots and grooves for the various sets of wire conductors.

The FIG. 4 structure is shown as having grooves 46 which run from the front of center sheet 44 through to the back of it. With this structure a viewer may possibly be able to see part of the cathode glow which exists at the bottom of each cavity. Although the amount of light which escapes through to the front of the panel is small, it could reduce the overall contrast ratio. Therefore, grooves 46 may be slanted so that a viewer looking at the panel from the front would be unable to see any part of cathode glow.

Grooves 46, shown as being generally circular in FIG. 4, may also be rectangular. In that case, the rectangular "grooves" will have a lengthwise dimension extending from the front to the back of center sheet 44 and a lateral dimension which is preferably equal to the width of apertures 50. The "height" of such rectangular grooves should be the smallest groove dimension, thereby giving the groove a "squashed" appearance. The theory behind the squashed groove is explained in detail in copending application Ser. No. 436,294, assigned to the assignee of this invention.

Additional advantage of the FIG. 4 structure is that the video voltages which are applied to the video anodes are relatively low, lower than the breakdown voltage of the gas itself. Since there is no video voltage present between adjacent video anodes that is higher than the sustaining voltage of the gas, the problem of cross-firing, leakages and back-fires that may occur in gas plasma tubes disappears.

As pointed out above, the scannable hollow cathode structure of FIG. 4 permits the generation of efficient high current density gas discharges at low gas pressures. Such reduced gas pressures permit higher electron temperatures to exist, thereby making the whole panel even more efficient and enabling the panel to run at a lower power consumption.

Specifically, the pressures and gases found suitable for the FIG. 4 structure are helium at a pressure of 100 torr and mercury at a pressure of 0.08 torr. At these pressures, highly efficient gas discharges are generated, as explained in detail in said copending application Ser. No. 436,294.

The preferred dimensions and materials for constructing the embodiment of this invention shown in FIG. 4 will now be given. Referring to FIG. 4, front sheet 66 is a piece of glass having a thickness on the order of 4–6 mils with a transparent conductive film 68 of tin oxide disposed thereon.

The next layer in the FIG. 4 structure is tub-forming sheet 48 which is preferably made of mica with a thickness of approximately 4 mils. The major axis (length) of each aperture 50 in sheet 48 is 38 mils while the minor axis (width) is 10 mils. The center to center spacing of apertures 50 in the row-wise direction is 20 mils and the center to center spacing in the column-wise direction is 43 mils. Mica is preferred for this sheet since it is easy to punch-form apertures 50 therein so as to produce nicely formed holes. Another alternative for sheet 48 is that it be thin glass with an array of apertures that are etched in a manner well known in the art.

Center sheet 44 is preferably made of a machinable glass ceramic or soda lime glass. However, whatever is used for center sheet 44 must have a co-efficient of expansion which is compatible with the other elements of the structure so that when the various layers are sealed together in a package the integrity of the seal will not be impaired.

The front-to-back length of center sheet 44 is preferably about 75 mils. Grooves 46 have a diameter of from 10–15 mils.

Wires 60 which constitute the video anode conductors and wires 52 which constitute the cathode scanning wires and wires 56 which constitute the scan anode conductors are all 5 mils in diameter.

Column-wise extending slots 62 are 6 mils wide and from 6 to mils deep. Grooves 64 which communicate with slots 62 are typically about 10 mils deep, just deep enough to place video anodes 60 somewhat beneath the tubs.

Slots 58 near the rear of center sheet 44 are in the order of 15 mils wide and 40 mils deep. Scan anodes 56 are inserted all the way into slots 58 as shown in FIG. 4.

The row-wise extending slots which hold cathode scanning wires 52 are approximately 6 mils wide and about 15 mils deep. Cathode scanning wires 52 are inserted all the way into their respective slots so that there is a gap between them and cathode plate 54. The center to center spacing between the wires of any pair of wires in a row is approximately 25 mils. The center to center spacing between adjacent pairs of wires is 43 mils. The 43 mil spacing between one row and another is appropriate for a 35 inch diagonal flat panel television display.

The final layer of the FIG. 4 structure is cathode sheet 54 which is preferably about 3 mils thick and made of a metal commonly known as Alloy Number 4, available from Sylvania Electric Products, Inc., Warren, Pa.

When the FIG. 4 structure is fully assembled, it may include a top glass covering plate and a bottom glass plate between which the layers shown in FIG. 4 are sandwiched. The entire structure may then be sealed together with a suitable sealant such as pyroceram or any other suitable sealant. Transparent conductive film 68 may be deposited on the underside of the front glass covering plate rather than on top of sheet 66. In either case, transparent conductive film 68 will be sandwiched between sheet 66 and the top glass covering plate.

Figure 6:
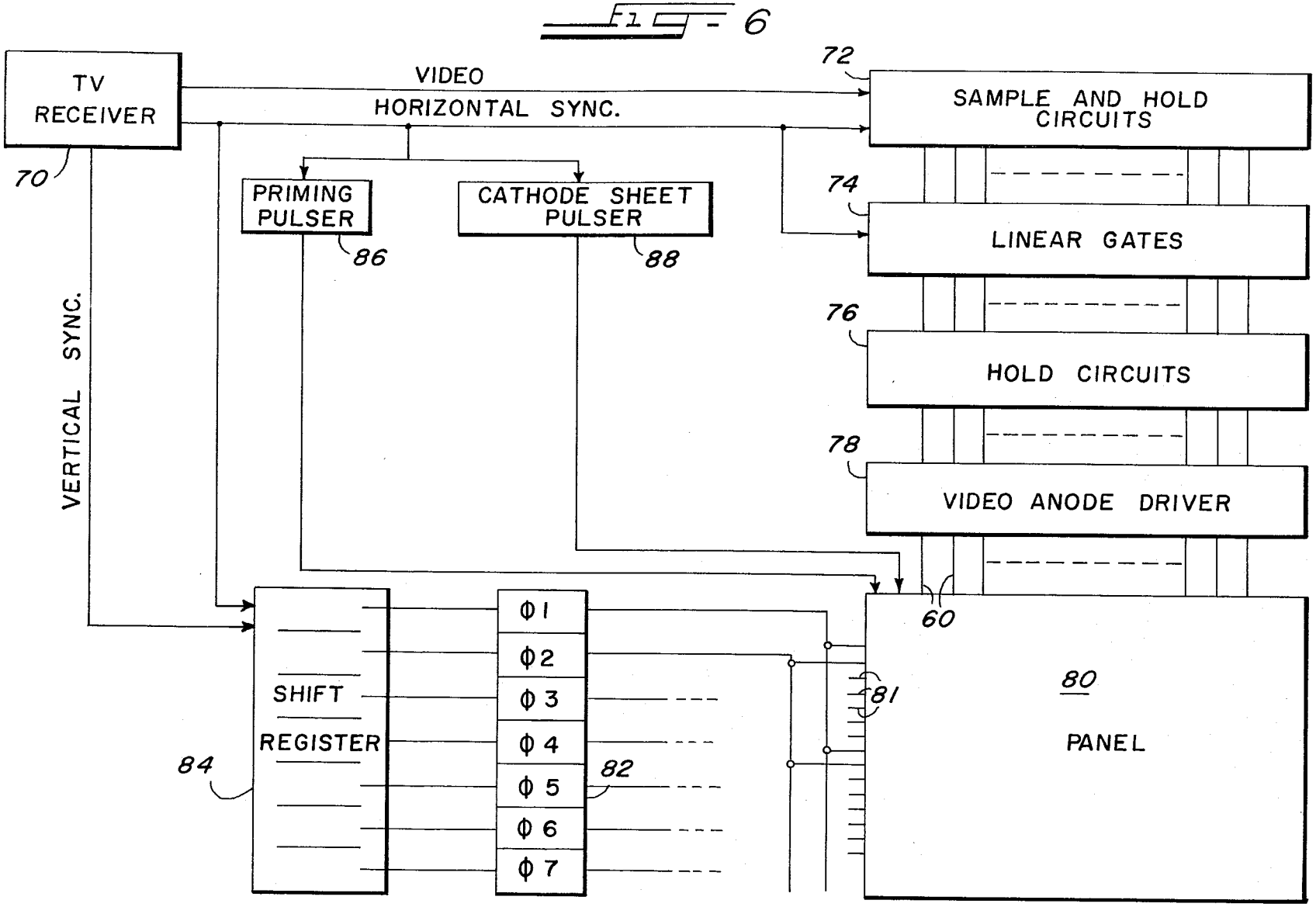
FIG. 6 is a schematic block diagram illustrating a gas discharge display panel of FIG. 4.

A system for displaying television images on the type of panel shown in FIG. 4 is illustrated in block diagram form in FIG. 6. The individual elements which drive the gas discharge panel are generally well known in the art.

Television receiver 70 provides the system with a source of a video signal, a horizontal sync signal and a vertical sync signal. The video signal is applied to sample and hold network 72 which samples the video signal once each horizontal line time in synchronization with the horizontal sync signal.

Linear gates 74 receive the horizontal sync signal from television receiver 70 and, when triggered by the horizontal sync signal, apply the sampled video signal stored in network 72 to individual hold circuits 76, one for each column of cells. Each hold circuit is coupled to a corresponding video anode driver 78 for driving video anodes 60 of the FIG. 4 panel.

Panel 80 is constructed according to FIG. 4 and consists, for example, of a 490 by 1400 array of cells.

Cathode scanning wires 81 are driven by seven phase cathode driver 82. Driver $\phi_1$ drives cathode scanning wires 1, 8, 15, etc., while cathode driver $\phi_2$ drives cathode scanning wires 2, 9, 16, etc.

Shift register 84 receives and resets on a vertical sync signal from television receiver 70 and drives seven phase cathode driver 82 to cause successive rows of panels 80 to be scanned in synchronism with the vertical and horizontal sync signal.

Priming pulser 86 receives the horizontal sync signal for developing a priming pulse (waveform E of FIG. 5) which is applied to conductive film 68 on front sheet 66 (FIG. 4).

Cathode sheet pulser 88 also receives the horizontal sync signal for generating a cathode control pulse (waveform D of FIG. 5) which is applied to cathode sheet 54 (FIG. 4).

Panel 80 operates in the same manner as described above for the FIG. 4 panel. The other blocks of the FIG. 6 system may be of conventional design and operate in a manner well known in the art.

While this invention has been described with specific embodiments thereof, it is evident that many alterations, modifications, and variations will be apparent to those skilled in the art in light of the above disclosure. This is particularly true of the way in which the priming electrode has been constructed and positioned. Such an electrode may be constructed in various ways, a preferred one of which has been specifically described with reference to FIG. 4. However, the broader concepts disclosed herein relative to the priming of the main discharge chambers are intended to embrace the different embodiments, alterations, and variations which fall within the scope of this invention as defined by the appended claims.

What is claimed is:

1. For use in a display device having a matrix of rows and columns of light emitting gas discharge cells, an improved gas discharge cell comprising:

enclosure means defining a gas-filled cell cavity;

cathode means disposed near the rear of the cavity and adapted to receive an electrical voltage;

a video anode situated in the front end of the cavity, the space in the cavity between the video anode and the cathode constituting a main discharge path; and a priming anode adapted to receive a priming voltage which is positive with respect to the cathode voltage, said priming anode extending along a substantial part of the main discharge path between the video anode and the cathode so that, when the priming voltage is applied to the priming anode, a part of the priming anode nearest the cathode establishes a priming discharge in the cavity between the cathode and the priming anode, which discharge is progressively propagated by the priming anode along the main discharge path toward the video anode so that a substantial portion of the distance between the cathode and the video anode is primed, thereby permitting the use of a low level video signal on the video anode to sustain and control the primed discharge.

2. A gas discharge cell as set forth in claim 1 which further includes scan anode means situated in the cavity forward of said cathode means, the space between said cathode means and said scan anode means constituting a scan discharge chamber, and wherein said priming anode is situated between scan anode means and said video anode, the space between said video anode and said scan anode means constituting a main discharge chamber which is primed by the diffusion of electrons from the scan discharge chamber and by the action of said priming anode.

3. A gas discharge cell as set forth in claim 1 wherein said priming anode is capacitively coupled to the cavity so as to establish a brief high energy electric field in the cavity upon application of a priming pulse thereto and an automatically decaying discharge therein and wherein said video anode receives an information containing electrical signal for sustaining the capacitively induced discharge in accordance with the information content of the electrical signal.

4. A gas discharge cell as set forth in claim 3 wherein said priming anode comprises a transparent insulator disposed near the front of the device and covering at least a part of the cavity, said insulator having a transparent conductive film on a side thereof opposite the cell cavity.

5. In combination with a gas discharge cell as set forth in claim 3, means for applying to said priming anode a periodic priming pulse of predetermined duration for establishing a periodic discharge in the cell, and means for applying to said video anode a video signal which begins during the presence of a priming pulse and which modulates the discharge in accordance with the information contained therein.

6. A gas discharge display device having a matrix of rows and columns of light emitting gas discharge cells comprising:

enclosure means defining a plurality of gas-filled cell cavities;

cathode means and anode means disposed across said cavities and near opposite ends thereof for sustaining a gas discharge therebetween; and a flat, transparent glass plate comprising a part of said enclosure means through which the cells are viewed and having a transparent conductive film and a side of the plate opposite the cavities, said film comprising one plate of a capacitor for receiving a periodic priming pulse for establishing an automatically decaying electric field between said plate and the cathode means so as to induce a gas discharge therebetween and to permit the continuation of the discharge by a voltage applied to the anode means that is less than required to initiate a discharge.

7. A gas discharge display device as set forth in claim 6 including means for supplying to said anode means an information-bearing anode pulse which begins during the presence of a priming pulse and which modulates the discharge in accordance with the information contained therein.

8. A gas discharge device comprising:

a matrix of rows and columns of gas-filled discharge cells;

an array of electrodes in the device arranged in the following order from the back to the front of the device:

cathode means;

scan anode means for establishing a scanning discharge between itself and the cathode means;

video anode means for receiving an information-bearing signal; and a flat transparent glass plate covering each cell cavity and having a transparent conductive film thereon, said film acting as one plate of a capacitor and being adapted to receive a periodic priming pulse for establishing an electric field between itself and the cathode means so as to induce a brief gas discharge therebetween and permit the video anode means to sustain the discharge with a relatively low voltage signal.

* * * * *